US009551084B2

(12) United States Patent
Shimoyama et al.

(10) Patent No.: US 9,551,084 B2
(45) Date of Patent: Jan. 24, 2017

(54) SN ALLOY PLATING APPARATUS AND SN ALLOY PLATING METHOD

(71) Applicant: EBARA CORPORATION, Tokyo (JP)

(72) Inventors: Masashi Shimoyama, Tokyo (JP); Masamichi Tamura, Tokyo (JP); Yuji Araki, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/526,421

(22) Filed: Oct. 28, 2014

(65) Prior Publication Data

US 2015/0136609 A1 May 21, 2015

(30) Foreign Application Priority Data

Oct. 31, 2013 (JP) ..... 2013-227086

(51) Int. Cl.
*C25D 21/16* (2006.01)
*C25D 3/60* (2006.01)
(Continued)

(52) U.S. Cl.
CPC ..... *C25D 21/16* (2013.01); *C25D 3/60* (2013.01); *C25D 17/002* (2013.01); *C25D 21/12* (2013.01);
(Continued)

(58) Field of Classification Search
CPC ..... C25D 21/16; C25D 21/18
(Continued)

(56) References Cited

U.S. PATENT DOCUMENTS 2,541,721 A * 2/1951 Roehl ..... C25D 21/18 204/232
4,181,580 A * 1/1980 Kitayama ..... C25D 3/30 204/206
(Continued)

FOREIGN PATENT DOCUMENTS

JP 11-021692 A 1/1999
JP 2000-219993 A 8/2000
(Continued)

*Primary Examiner* — Bryan D. Ripa
(74) *Attorney, Agent, or Firm* — Baker & Hostetler LLP

(57) ABSTRACT

An Sn alloy plating apparatus is disclosed which can relatively easily perform control of an Sn alloy plating solution, including control of the Sn ion concentration and the acid concentration of the plating solution. The Sn alloy plating apparatus includes: a plating bath configured to hold therein an Sn alloy plating solution in which an insoluble anode a the substrate are to be disposed opposite each other; a plating-solution circulation line configured to circulate the Sn alloy plating solution in the plating bath; an Sn supply reservoir configured to draw a part of the Sn alloy plating solution from the plating-solution circulation line, perform electrolysis in a presence of the Sn alloy plating solution to replenish the Sn alloy plating solution with Sn ions and an acid that stabilizes Sn ions, and return the Sn alloy plating solution that has been replenished with the Sn ions to the plating bath; and a dialysis unit configured to draw a part of the Sn alloy plating solution from the plating-solution circulation line, remove the acid from the Sn alloy plating solution, and then return the Sn alloy plating solution to the plating bath.

3 Claims, 7 Drawing Sheets

(51) Int. Cl.

| | |
|---|---|
| ***C25D 21/12*** | (2006.01) |
| ***C25D 21/18*** | (2006.01) |
| *C25D 17/00* | (2006.01) |
| *C25D 17/06* | (2006.01) |

(52) U.S. Cl.
CPC ..... *C25D 21/18* (2013.01); *C25D 17/001* (2013.01); *C25D 17/06* (2013.01)

(58) Field of Classification Search
USPC ..... 205/101
See application file for complete search history.

(56) References Cited

U.S. PATENT DOCUMENTS

| | | | | |
|---|---|---|---|---|
| 4,789,439 | A * | 12/1988 | Bunk | C25D 3/30 204/234 |
| 5,312,539 | A * | 5/1994 | Thomson | C25D 3/30 204/DIG. 13 |
| 6,251,255 | B1 * | 6/2001 | Copping | C25D 21/14 204/237 |
| 2004/0182694 | A1 * | 9/2004 | Nevosi | C25D 21/18 204/252 |

FOREIGN PATENT DOCUMENTS

| | | | |
|---|---|---|---|
| JP | 2003-105581 | A | 4/2003 |
| JP | 2005-139474 | A | 6/2005 |

* cited by examiner

SN ALLOY PLATING APPARATUS AND SN ALLOY PLATING METHOD

CROSS REFERENCE TO RELATED APPLICATION

This document claims priority to Japanese Patent Application Number 2013-227086 filed Oct. 31, 2013, the entire contents of which are hereby incorporated by reference.

BACKGROUND

As is known in the art, a film of an alloy of Sn (tin) and a metal which is nobler than Sn (e.g., an Sn—Ag alloy which is an alloy of Sn and silver), formed by electroplating on a substrate surface, is used for lead-free solder bumps. Sn—Ag alloy plating is typically carried out by applying a voltage between an anode and a substrate surface, which are disposed opposite to each other and immersed in an Sn—Ag alloy plating solution containing Sn ions and Ag ions, thereby forming a metal film of Sn—Ag alloy on the substrate surface. Other than the Sn—Ag alloy, an Sn—Cu alloy which is an alloy of Sn and Cu (copper), an Sn—Bi alloy which is an alloy of Sn and Bi (bismuth), or the like can be used as an alloy of Sn and a metal which is nobler than Sn.

Japanese Patent No. 4441725 discloses an Sn alloy plating method using a soluble anode made of Sn (i.e., Sn anode). The Sn anode is disposed in an anode chamber, which is separated from a cathode chamber by an anion exchange membrane. An Sn plating solution and an acid or a salt thereof are held in the anode chamber, while an Sn alloy plating solution is held in the cathode chamber. Sn ions in the anode chamber are supplied through a (liquid) replenishment line to the Sn alloy plating solution in a plating bath.

Japanese Patent No. 3368860 discloses an Sn alloy plating method in which plating of a workpiece, disposed in a plating bath, is performed using an Sn anode that is isolated in the plating bath by means of an anode bag or box formed of a cation exchange membrane.

Japanese laid-open patent publication No. 2003-105581 discloses an Sn alloy plating method using an insoluble anode made of e.g., titanium. In this plating method, Sn is dissolved from an Sn anode in a dissolution bath that is different from a plating bath (or an electrolytic bath), and the dissolved Sn is supplied to an Sn alloy plating solution.

Japanese laid-open patent publication No. H11-21692 discloses an Sn—Ag alloy plating method which involves the steps of providing an auxiliary bath, having a cathode chamber and an anode chamber separated by a diaphragm or partition so that a substance that would cause deterioration will not diffuse into the cathode chamber, and supplying Sn ions to a plating solution (or an anolyte) held in the anode chamber in the auxiliary bath.

The Sn—Ag alloy plating is generally performed with use of an Sn—Ag alloy plating solution containing a salt of an acid capable of forming a water-soluble salt with Sn ion ($Sn^{2+}$), e.g., tin methanesulfonate, and a salt of an acid capable of forming a water-soluble salt with Ag ion ($Ag^{+}$), e.g., silver methanesulfonate.

When Sn alloy plating is carried out with use of a soluble anode (Sn anode), Sn ions dissolve from the Sn anode into an Sn alloy plating solution, and therefore an Sn ion concentration of the Sn alloy plating solution increases. Because of this, it is generally difficult to keep the Sn alloy plating solution at a predetermined Sn ion concentration.

When Sn—Ag alloy plating is carried out with use of an insoluble anode made of e.g., titanium, metal ions (Sn ions and Ag ions) and a free acid, e.g., methanesulfonic acid, are separated from each other with the progress of Sn—Ag alloy plating. The metal ions are consumed by plating, and therefore an acid concentration of the Sn—Ag alloy plating solution gradually increases. In order to compensate for the consumption of the metal ions, it is desirable to replenish the Sn—Ag alloy plating solution with metal ions (preferably metal ions dissolved from a metal) and to adjust the acid concentration of the Sn—Ag alloy plating solution within a preferable range so that good appearance of the resulting metal film and a uniformity of a film thickness can be maintained.

Sn ions are consumed in Sn alloy plating. In the plating method disclosed in the above-mentioned patent publication 3, Sn ions that have been dissolved from the Sn anode are supplied to the Sn alloy plating solution. However, no consideration is given to the concentration of an acid, such as methanesulfonic acid, contained in the Sn alloy plating solution. It therefore appears that, while the Sn alloy plating solution can be kept at a constant Sn concentration, the acid concentration of the Sn alloy plating solution may fall outside a preferable range, resulting in poor appearance of the resulting metal film and non-uniformity of a film thickness.

SUMMARY OF THE INVENTION

According to embodiments described below, there are provided an Sn alloy plating apparatus and an Sn alloy plating method which can relatively easily perform control of an Sn alloy plating solution, including control of an Sn ion concentration and an acid concentration of the plating solution, with a relatively simple construction that can be relatively easily installed.

Embodiments, which will be described below, relate to an Sn alloy plating apparatus and an Sn alloy plating method for use in forming a film of an alloy of Sn and a metal which is nobler than Sn (for example, a lead-free Sn—Ag alloy having good soldering properties) on a substrate surface.

In an embodiment, there is provided an Sn alloy plating apparatus for depositing an alloy of Sn and a metal which is nobler than Sn on a surface of a substrate, comprising: a plating bath configured to hold therein an Sn alloy plating solution in which an insoluble anode and the substrate are to be disposed opposite each other; a plating-solution circulation line configured to circulate the Sn alloy plating solution in the plating bath; an Sn supply reservoir configured to draw a part of the Sn alloy plating solution from the plating-solution circulation line, perform electrolysis in a presence of the Sn alloy plating solution to replenish the Sn alloy plating solution with Sn ions and an acid that stabilizes Sn ions, and return the Sn alloy plating solution that has been replenished with the Sn ions to the plating bath; and a dialysis unit configured to draw a part of the Sn alloy plating solution from the plating-solution circulation line, remove the acid from the Sn alloy plating solution, and then return the Sn alloy plating solution to the plating bath.

Because the Sn alloy plating solution that has been replenished with the Sn ions is returned to the plating bath, the Sn alloy plating solution for use in plating can be kept at a constant Sn concentration. Further, the acid existing in excess in the Sn alloy plating solution can be removed by the dialysis unit. Therefore, the acid concentration of the Sn alloy plating solution can be adjusted within a preferable range.

In an embodiment, the Sn supply reservoir comprises: an electrolytic bath including an anode chamber in which an Sn anode is disposed, a cathode chamber in which a cathode is disposed, and an anion exchange membrane that separates the anode chamber and the cathode chamber from each other; an electrolytic-solution supply line configured to supply an electrolytic solution, containing acid that stabilizes Sn ions, to the cathode chamber; an electrolytic-solution discharge line configured to discharge the electrolytic solution from the cathode chamber; a plating-solution introduction line configured to draw the Sn alloy plating solution from the plating-solution circulation line and introduce the drawn Sn alloy plating solution into the anode chamber; and a plating-solution return line configured to return the Sn alloy plating solution in the anode chamber to the plating bath.

By applying a voltage between the cathode in the cathode chamber and the Sn anode in the anode chamber while introducing the Sn alloy plating solution into the anode chamber of the electrolytic bath of the Sn supply reservoir, the Sn alloy plating solution in the anode chamber can be replenished with Sn ions and the acid that stabilizes Sn ions. Further, the concentration of the acid that stabilizes Sn ions contained in the electrolytic solution in the cathode chamber can be adjusted through the electrolytic-solution supply line and the electrolytic-solution discharge line.

In an embodiment, the Sn supply reservoir further comprises: a pure-water supply line configured to supply pure water into the anode chamber; and a pure-water discharge line configured to discharge the pure water from the anode chamber.

In an embodiment, the Sn supply reservoir comprises: an electrolytic bath including an anode chamber in which an Sn anode is disposed, a cathode chamber in which a cathode is disposed, a plating-solution chamber being adjacent to the anode chamber and the cathode chamber, and an anion exchange membrane that separates the anode chamber, the cathode chamber, and the plating-solution chamber from each other; electrolytic-solution supply lines configured to supply an electrolytic solution, containing acid that stabilizes Sn ions, to the anode chamber and the cathode chamber; electrolytic-solution discharge lines configured to discharge the electrolytic solution from the anode chamber and the cathode chamber; a plating-solution introduction line configured to draw the Sn alloy plating solution from the plating-solution circulation line and introduce the drawn Sn alloy plating solution into the plating-solution chamber; a plating-solution return line configured to return the Sn alloy plating solution in the plating-solution chamber to the plating bath; and a power source configured to apply a voltage between the Sn anode and the cathode to cause the electrolytic solution in the anode chamber to overflow into the plating-solution chamber.

When a voltage is applied between the Sn anode in the anode chamber and the cathode in the cathode chamber, Sn ions dissolve from the Sn anode into the electrolytic solution in the anode chamber. At the same time, the acid that stabilizes Sn ions, together with water molecules, passes through the anion exchange membrane and migrates into the anode chamber, whereby the surface level of the electrolytic solution in the anode chamber rises. With the rise of the surface level, the electrolytic solution in the anode chamber overflows into the electrolytic bath, so that the Sn alloy plating solution in the electrolytic bath can be replenished with Sn ions and the acid that stabilizes Sn ions.

In an embodiment, there is provided an Sn alloy plating method for depositing an alloy of Sn and a metal which is nobler than Sn on a surface of a substrate, comprising: immersing an insoluble anode and the substrate, disposed opposite each other, in an Sn alloy plating solution held in a plating bath; applying a voltage between the insoluble anode and the substrate while circulating the Sn alloy plating solution through a plating-solution circulation line to plate the surface of the substrate; drawing a part of the Sn alloy plating solution from the plating-solution circulation line; performing electrolysis in a presence of the drawn Sn alloy plating solution to replenish the Sn alloy plating solution with Sn ions and an acid that stabilizes Sn ions; returning the Sn alloy plating solution that has been replenished with the Sn ions to the plating bath; drawing a part of the Sn alloy plating solution from the plating-solution circulation line; and removing the acid from the drawn Sn alloy plating solution and then returning the Sn alloy plating solution to the plating bath.

In an embodiment, replenishing the Sn alloy plating solution with Sn ions and the acid that stabilizes Sn ions comprises: introducing an electrolytic solution containing acid that stabilizes Sn ions into a cathode chamber that is separated from an anode chamber by an anion exchange membrane; drawing the Sn alloy plating solution from the plating-solution circulation line and then introducing the drawn Sn alloy plating solution into the anode chamber; and applying a voltage between a cathode disposed in the cathode chamber and an Sn anode disposed in the anode chamber to replenish the Sn alloy plating solution in the anode chamber with Sn ions and the acid that stabilizes Sn ions.

In an embodiment, the Sn alloy plating method further comprises when the voltage is not being applied between the cathode and the Sn anode, applying a low voltage between the cathode and the Sn anode in the electrolytic bath in order to prevent sedimentation of metal which is nobler than Sn upon contact of the metal with the Sn anode.

In this manner, a low voltage (e.g., at least about 1 V), which is slightly higher than a standard electrode potential difference between Sn and metal which is nobler than Sn, such as Ag, is applied between the cathode and the Sn anode in the electrolytic bath when electrolysis is not performed in the electrolytic bath. This operation can prevent sedimentation of Ag in the plating solution upon contact of Ag with the Sn anode. Examples of "when electrolysis is not performed in the electrolytic bath" include a time when the Sn alloy plating solution begins to be introduced into the anode chamber and a period of time when the Sn alloy plating solution in the anode chamber is returned to the plating bath in order to replace the Sn alloy plating solution in the anode chamber with water.

In an embodiment, the Sn alloy plating method further comprises according to claim 6, further comprising filling the anode chamber with pure water when the voltage is not being applied between the cathode and the Sn anode.

In an embodiment, replenishing the Sn alloy plating solution with Sn ions and the acid that stabilizes Sn ions comprises: introducing an electrolytic solution containing acid that stabilizes Sn ions into an anode chamber and a cathode chamber that are separated from each other by an anion exchange membrane; drawing the Sn alloy plating solution from the plating-solution circulation line and then introducing the drawn Sn alloy plating solution into a plating-solution chamber that is separated from the anode chamber and the cathode chamber by the anion exchange membrane; and applying a voltage between a cathode disposed in the cathode chamber and an Sn anode disposed in the anode chamber to cause the electrolytic solution in the anode chamber to overflow into the plating-solution chamber.

According to the embodiments described above, Sn ions and acid that stabilizes Sn ions are supplied by the Sn supply reservoir to the Sn alloy plating solution to be used in the plating bath in a circulatory manner, and the Sn alloy plating solution that has been replenished with Sn ions is returned to the plating bath. As a result, the Sn alloy plating solution to be used in plating can be kept at a constant Sn concentration. Further, the acid that exists in excess in the Sn alloy plating solution is removed by the dialysis unit so that the acid concentration of the Sn alloy plating solution can be adjusted within a preferable range. In addition, the Sn supply reservoir and the dialysis unit can be installed at a distance from the plating bath. Therefore, the Sn supply reservoir and the dialysis unit can be relatively easily added to an existing plating apparatus.

DESCRIPTION OF THE EMBODIMENTS

Embodiments will now be described with reference to the drawings. The following descriptions illustrate a case where Ag (silver) is used as a metal nobler than Sn (tin), and a metal film of Sn—Ag alloy is formed on a surface of a substrate. Methanesulfonic acid (MSA) is used as an acid that stabilizes Sn ions (and Ag ions), and an Sn—Ag alloy plating solution is used as a plating solution. This Sn—Ag alloy plating solution contains tin methanesulfonate as Sn ions ($Sn^{2+}$) and silver methanesulfonate as Ag ions ($Ag^{+}$).

Figure 1:
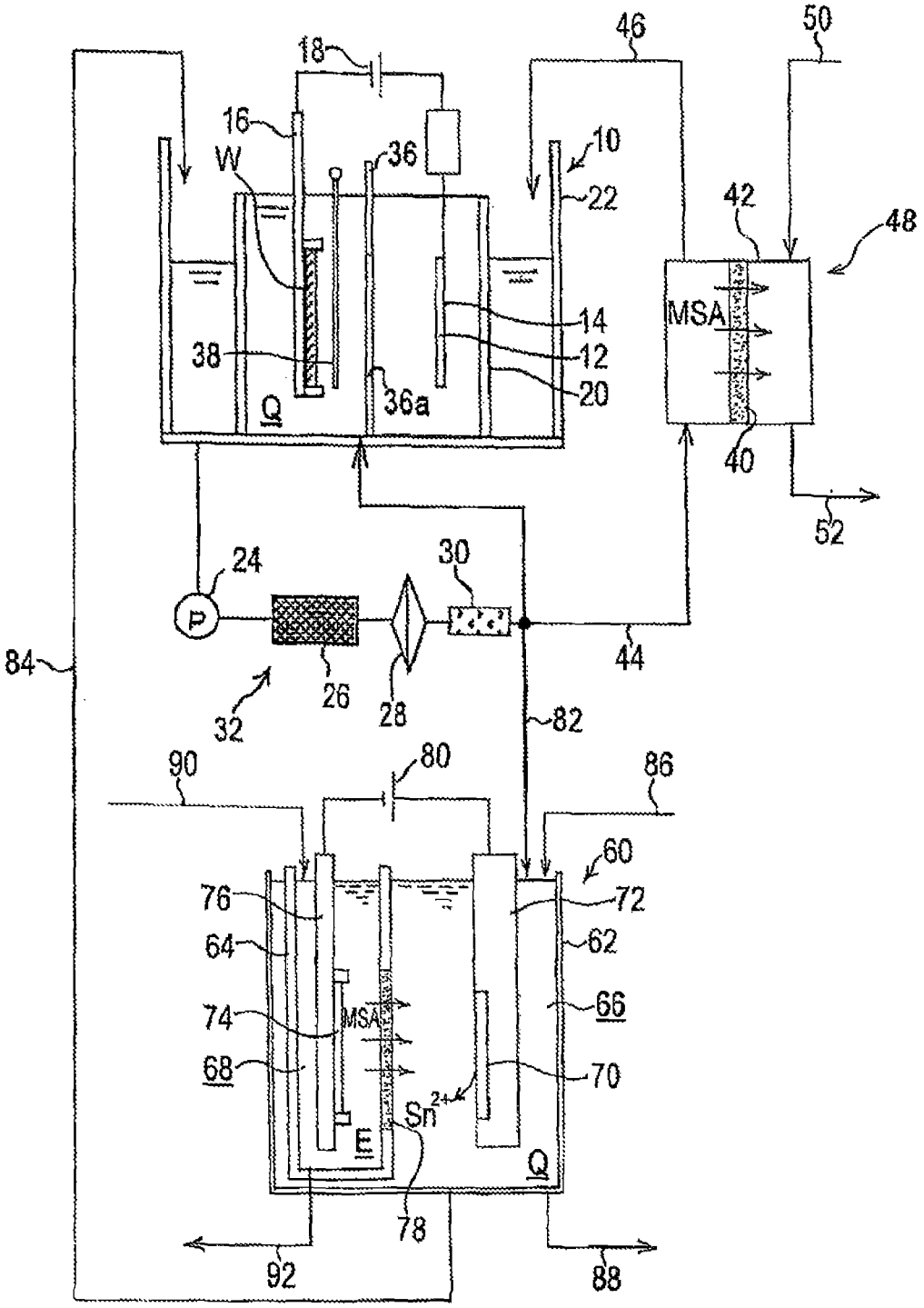
FIG. 1 is a schematic view of an Sn alloy plating apparatus according to an embodiment.
Figure 2:
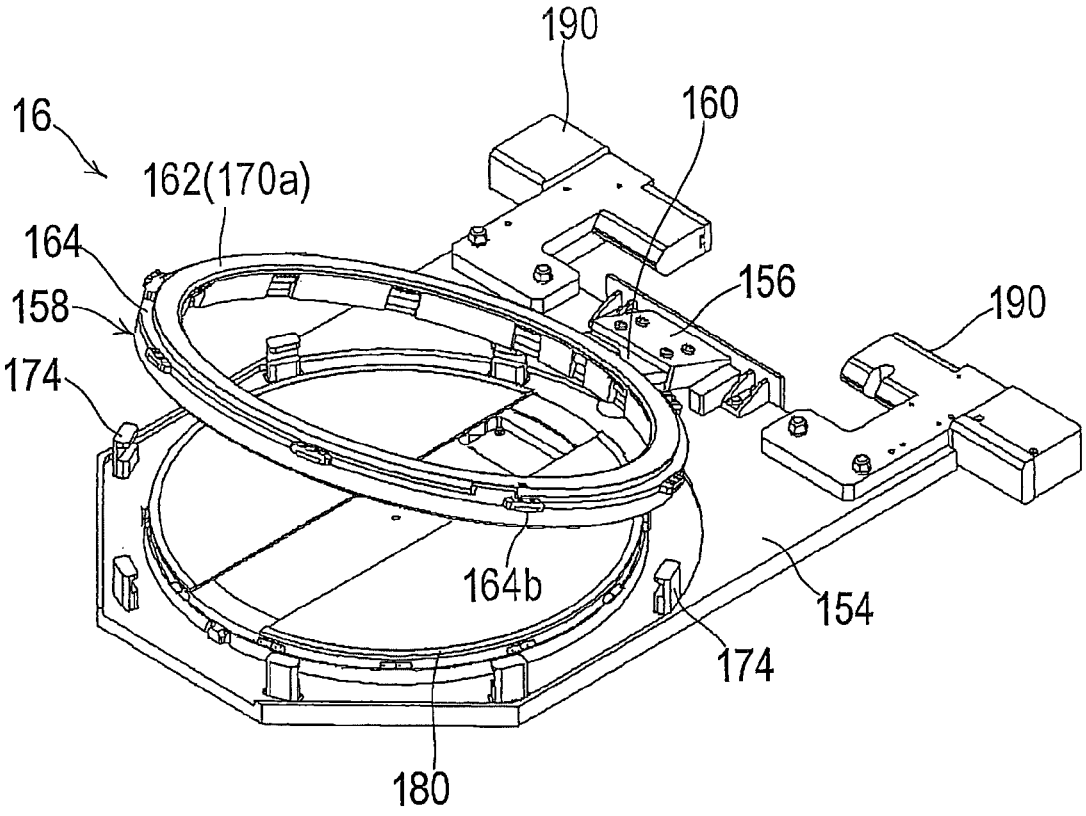
FIG. 2 is a schematic perspective view of a substrate holder shown in FIG. 1.

FIG. 1 is a schematic view of an Sn alloy plating apparatus according to an embodiment. As shown in FIG. 1, the Sn alloy plating apparatus includes a plating bath 10 for holding therein an Sn alloy plating solution Q (hereinafter referred to simply as plating solution Q), an anode holder 14 that holds an insoluble anode 12, which may be made of titanium, and immerses the insoluble anode 12 in the plating solution Q at a predetermined location in the plating bath 10, and a substrate holder 16 for detachably holding a substrate W. The substrate W held by the substrate holder 16 is immersed in the plating solution Q retained in the plating bath 10 at a predetermined location opposite the insoluble anode 12.

When plating of the substrate W is performed, the insoluble anode 12 is electrically connected to a positive electrode of a plating power source 18, while a conductive layer (not shown), such as a seed layer, that forms a surface of the substrate W is electrically connected to a negative electrode of the plating power source 18. As a result, a metal film of Sn—Ag alloy is formed by plating on a surface of the conductive layer. This metal film may be used for the production of lead-free solder bumps.

The plating bath 10 includes an inner bath 20 for storing the plating solution Q therein, and an overflow bath 22 that is adjacent to the inner bath 20. The plating solution Q overflows a top edge of the inner bath 20 into the overflow bath 22. One end of a plating-solution circulation line 32 is coupled to a bottom of the overflow bath 22. The plating-solution circulation line 32 is provided with a pump 24, a heat exchanger or a temperature regulator) 26, a filter 28, and a flow meter 30. Other end of the plating-solution circulation line 32 is coupled to a bottom of the inner bath 20.

A regulation plate 36 for regulating a distribution of electric potential in the plating bath 10 is disposed between the insoluble anode 12 and the substrate holder 16 in the plating bath 10. In this embodiment, the regulation plate 36 is made of polyvinyl chloride, which is a dielectric material, and has a central hole **36*a* having such a size as to sufficiently regulate spreading of an electric field. A lower end of the regulation plate 36 reaches a bottom plate of the plating bath 10**.

An agitating paddle 38, which is an agitating tool for the plating solution, is disposed in the plating bath 10. This agitating paddle 38 is configured to reciprocate parallel to the substrate W to thereby agitate the plating solution Q existing between the substrate W and the regulation plate 36. The agitating paddle 38 is located between the substrate holder 16 and the regulation plate 36 and is installed in as vertical position. By agitating the plating solution Q with use of the agitating paddle (agitating tool) 38 during plating of the substrate W, a sufficient amount of metal ions can be supplied uniformly to the surface of the substrate W.

A plating-solution supply line 44 for supplying the plating solution Q to a dialysis cell 42 is coupled to the plating-solution circulation line 32. This plating-solution supply line 44 is located downstream of the flow meter 30. An anion exchange membrane 40 is disposed in the dialysis cell 42. A plating-solution discharge line 46 extending from the dialysis cell 42 is coupled to the top of the overflow bath 22. The plating-solution supply line 44, the plating-solution discharge line 46, and the dialysis cell 42 constitute a dialysis unit 48. This dialysis unit 48 is coupled to the plating-solution circulation line 32. A part of the plating solution Q, flowing in the plating-solution circulation line 32, is fed through the plating-solution supply line 44 to the dialysis cell 42, and returned from the dialysis cell 42 to the overflow bath 22 via the plating-solution discharge line 46. A pure-water supply line 50 for supplying pure water into the dialysis cell 42 and a pure-water discharge line 52 for discharging the pure water out of the dialysis cell 42 are coupled to the dialysis cell 42.

A part of the plating solution Q, flowing in the plating-solution circulation line 32, is supplied into the dialysis cell 42, where at least a part of methanesulfonic acid or MSA (which exists as a free acid that has been separated from tin methanesulfonate and silver methanesulfonate) and methanesulfonic acid (which, as described below, has been added to the plating solution Q in an anode chamber 66 of an Sn supply reservoir 60) is removed by dialysis using the anion exchange membrane 40. After the removal of methanesulfonic acid in the dialysis cell 42, the plating solution Q is returned to the overflow bath 22 via the plating-solution discharge line 46. The methanesulfonic acid that has been removed from the plating solution Q by the dialysis diffuses into the pure water that has been supplied through the pure-water supply line 50 into the dialysis cell 42, and is discharged to the outside via the pure-water discharge line 52.

The anion exchange membrane 40 may be formed from DSV (an effective membrane area 0.0172 $m^2$) manufactured by AGC Engineering Co., Ltd. An arbitrary number (e.g., 19) of such membranes may be incorporated in the dialysis cell 42 depending on an amount of the plating solution to be dialyzed (i.e., an amount of methanesulfonic acid to be removed).

The Sn alloy plating apparatus further includes the Sn supply reservoir 60 for replenishing the plating solution Q to be used in the plating bath 10 with Sn ions and methanesulfonate ions. The Sn supply reservoir 60 includes an electrolytic bath 62, whose interior is separated into an anode chamber 66 and a cathode chamber 68 by a partition 64 that in a shape of open-top box.

A soluble Sn anode 70 made of Sn, held by an anode holder 72, is disposed in the anode chamber 66. A cathode 74, held by a cathode holder 76, is disposed in the cathode chamber 68. The cathode 74 may be formed from a platinum or titanium plate. The Sn anode 70 and the cathode 74 are disposed opposite each other. The partition 64 is provided with an anion exchange membrane 78 that faces the Sn anode 70. When electrolysis is performed, the Sn anode 70 is electrically connected to a positive electrode of an auxiliary power source 80, and the cathode 74 is electrically connected to a negative electrode of the auxiliary power source 80. As with the above-described anion exchange membrane 40, the anion exchange membrane 78 may be formed from DSV (an effective membrane area 0.0172 $m^2$), manufactured by AGC Engineering Co., Ltd.

A plating-solution introduction line 82 for drawing a part of the plating solution Q from the plating-solution circulation line 32 is coupled to the plating-solution circulation line 32. This plating-solution introduction line 82 is located downstream of the flow meter 30. One end of the plating-solution introduction line 82 is coupled to the plating-solution circulation line 32, while the other end of the plating-solution introduction line 82 is coupled to the anode chamber 66 of the electrolytic bath 62. Accordingly, a part of the plating solution Q in the plating-solution circulation line 32 flows into the plating-solution introduction line 82, and is introduced through the plating-solution introduction line 82 into the anode chamber 66 of the electrolytic bath 62.

A plating-solution return line 84 for returning the plating solution Q in the anode chamber 66 to the overflow bath 22 of the plating bath 10 is coupled to the anode chamber 66. More specifically, one end of the plating-solution return line 84 is coupled to the anode chamber 66 and other end is coupled to the overflow bath 22. A pure-water supply line 86 for supplying pure water into the anode chamber 66 and a pure-water discharge line 88 for discharging the pure water out of the anode chamber 66 are coupled to the anode chamber 66. The Sn anode 70 is immersed in the plating solution Q or the pure water that has been supplied into the anode chamber 66.

An electrolytic-solution supply line 90 for supplying an electrolytic solution E into the cathode chamber 68 and an electrolytic-solution discharge line 92 for discharging the electrolytic solution E from the cathode chamber 68 are coupled to the cathode chamber 68. An electrolytic solution containing methanesulfonic acid (MSA) that stabilizes Sn ions is used as the electrolytic solution E. During electrolysis which will be described below, only the methanesulfonic acid contained in the electrolytic solution E passes through the anion exchange membrane 78. The cathode 74 is immersed in the electrolytic solution E that has been supplied into the cathode chamber 68.

In the electrolytic bath 62 of the Sn supply reservoir 60, electrolysis is carried out when the Sn anode 70 in the anode chamber 66 is electrically connected to the positive electrode of the auxiliary power source 80 and the cathode 74 in the cathode chamber 68 is electrically connected to the negative electrode of the auxiliary power source 80 with the anode chamber 66 filled with the plating solution Q and the cathode chamber 68 filled with the electrolytic solution E. During the electrolysis, Sn ions are dissolved from the Sn anode 70 into the plating solution Q in the anode chamber 66. At the same time, only methanesulfonic acid (MSA), contained in the electrolytic solution E in the cathode chamber 68, passes through the anion exchange membrane 78 and migrates into the anode chamber 66. Due to the migration of methanesulfonic acid (MSA), Sn ions that have been dissolved in the plating solution Q in the anode chamber 66 can exist stably. In this manner, the plating solution Q in the anode chamber 66 is replenished with Sn ions and methanesulfonic acid. The plating solution Q in the anode chamber 66, which has been replenished with Sn ions, is returned to the overflow bath 22 of the plating bath 10 via the plating-solution return line 84. If necessary, the Sn supply reservoir 60 may be provided with a supply line (not shown) for supplying methanesulfonic acid to the plating solution Q in the anode chamber 66 from the outside.

As the electrolysis is performed while applying the voltage between the Sn anode 70 and the cathode 74, the concentration of methanesulfonic acid contained in the electrolytic solution E in the cathode chamber 68 gradually decreases. The concentration of methanesulfonic acid in the electrolytic solution E in the cathode chamber 68 can be adjusted by supplying an electrolytic solution, containing a sufficient amount of methanesulfonic acid, into the cathode chamber 68 through the electrolytic-solution supply line 90 when the methanesulfonic acid concentration of the electrolytic solution E is lowered. Since a part of the electrolytic solution E in the cathode chamber 68 is discharged through the electrolytic-solution discharge line 92 to the outside, a material balance upon the addition of methanesulfonic acid to the plating solution Q in the anode chamber 66 can be maintained.

As shown in FIGS. 2 through 5, the substrate holder 16 includes a first holding member 154 having a rectangular plate shape and made of e.g., vinyl chloride, and a second holding member 158 rotatably coupled to the first holding member 154 through a hinge 156 which allows the second holding member 158 to open and close with respect to the first holding member 154. Although in this embodiment the second holding member 158 is configured to be openable and closable through the hinge 156, it is also possible to dispose the second holding member 158 opposite to the first holding member 154 and to move the second holding member 158 away from and toward the first holding member 154 to thereby open and close the second holding member 158.

The second holding member 158 includes a base portion 160 and a ring-shaped seal holder 162. The seal holder 162 is made of vinyl chloride so as to enable a retaining ring 164, which will be described later, to slide well. An annular substrate-side sealing member 166 (see FIGS. 4 and 5) is fixed to an upper surface of the seal holder 162. This substrate-side sealing member 166 is brought into pressure contact with a periphery of the surface of the substrate W to seal a gap between the substrate W and the second holding member 158 when the substrate W is held by the substrate holder 16. An annular holder-side sealing member 168 (see FIGS. 7 and 8) is fixed to a surface, facing the first holding member 154, of the seal holder 162. This holder-side sealing member 168 is brought into pressure contact with the first holding member 154 to seal a gap between the first holding member 154 and the second holding member 158. The holder-side sealing member 168 is located outwardly of the substrate-side sealing member 166.

Figure 5:
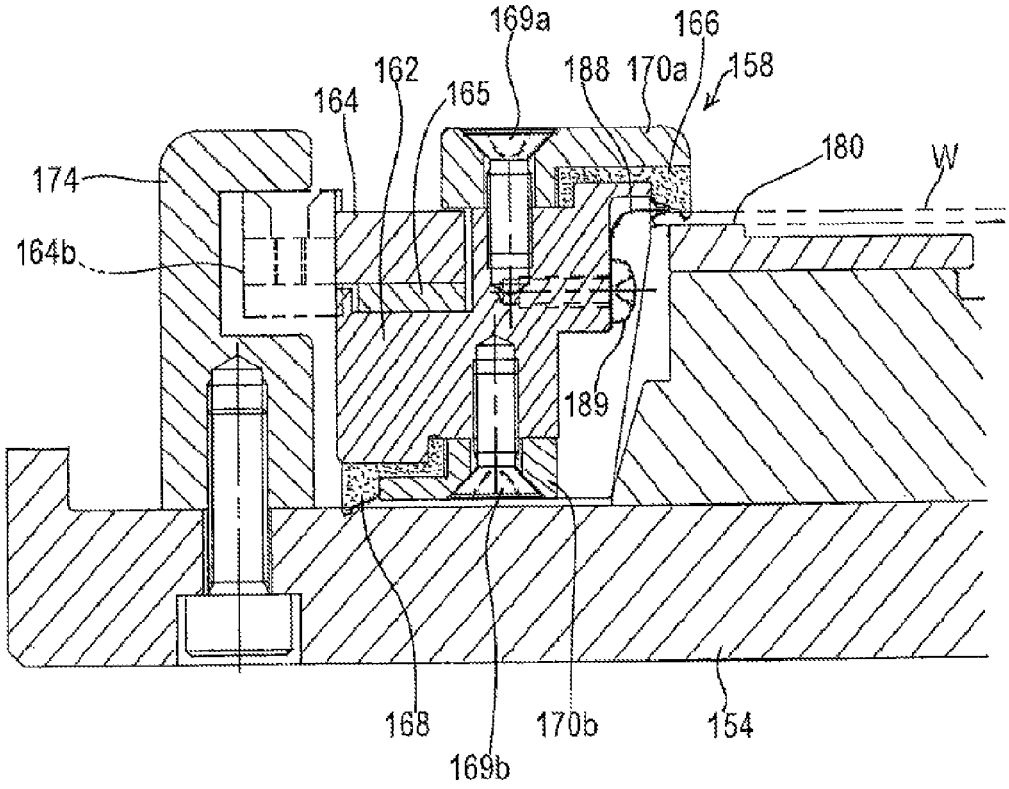
FIG. 5 is an enlarged view of a portion A of FIG. 4.

As shown in FIG. 5, the substrate-side sealing member 166 is sandwiched between the seal holder 162 and a first mounting ring 170*a* which is secured to the seal holder 162 by fastening tools 169*a*, such as bolts. The holder-side sealing member 168 is sandwiched between the seal holder 162 and a second mounting ring 170*b* which is secured to the seal holder 162 by fastening tools 169*b*, such as bolts.

The seal holder 162 has a stepped portion at a periphery thereof, and the retaining ring 164 is rotatably mounted to the stepped portion through a spacer 165. The retaining ring 164 is inescapably held by an outwardly projecting retaining plates 172 (see FIG. 3) mounted to a side surface of the seal holder 162. This retaining ring 164 is made of a material (e.g., titanium) having high rigidity and excellent acid and alkali corrosion resistance and the spacer 165 is made of a material having a low friction coefficient, for example PTFE, so that the retaining ring 164 can rotate smoothly.

Inverted L-shaped clampers 174, each having an inwardly projecting portion and located outside of the retaining ring 164, are provided on the first holding member 154 at equal intervals along a circumferential direction of the retaining ring 164. The retaining ring 164 has outwardly projecting portions 164*b* arranged along the circumferential direction of the retaining ring 164 at positions corresponding to positions of the clampers 174. A lower surface of the inwardly projecting portion of each clamper 174 and an upper surface of each projecting portion 164*b* of the retaining ring 164 are inclined in opposite directions along the rotational direction of the retaining ring 164 to form tapered surfaces. A plurality of (e.g., three) upwardly protruding dots 164*a* are provided on the retaining ring 164 in predetermined positions along the circumferential direction of the retaining ring 164. The retaining ring 164 can be rotated by pushing and moving each dot 164*a* from a lateral direction by means of a rotating pin (not shown).

When the second holding member 158 is open, the substrate W is inserted into the central portion of the first holding member 154, and the second holding member 158 is then closed through the hinge 156. Subsequently the retaining ring 164 is rotated clockwise so that each projecting portion 164*b* of the retaining ring 164 slides into the inwardly projecting portion of each clamper 174. As a result, the first holding member 154 and the second holding member 158 are fastened to each other and locked by engagement between the tapered surfaces of the retaining ring 164 and the tapered surfaces of the clampers 174. The lock of the second holding member 158 can be released by rotating the retaining ring 164 counterclockwise and to disengage the projecting portions 164*b* of the retaining ring 164 from the inverted L-shaped clampers 174.

When the second holding member 158 is locked in the above-described manner, the downwardly-protruding portion of the substrate-side sealing member 166 is placed in pressure contact with the periphery of the surface of the substrate W. The substrate-side sealing member 166 is pressed uniformly against the substrate W to thereby seal the gap between the periphery of the surface of the substrate W and the second holding member 158. Similarly, when the second holding member 158 is locked, the downwardly-protruding portion of the holder-side sealing member 168 is placed in pressure contact with the surface of the first holding member 154. The sealing holder-side sealing member 168 is uniformly pressed against the first holding member 154 to thereby seal the gap between the first holding member 154 and the second holding member 158.

A pair of T-shaped holder hangers 190 are provided on end portions of the first holding member 154. A protruding portion 182 is formed on the upper surface of the first holding member 154 so as to protrude in a ring shape corresponding to a size of the substrate W. The protruding portion 182 has an annular support surface 180 which is placed in contact with the periphery of the substrate W to support the substrate W. The protruding portion 182 has recesses 184 arranged at predetermined positions along a circumferential direction of the protruding portion 182.

Figure 3:
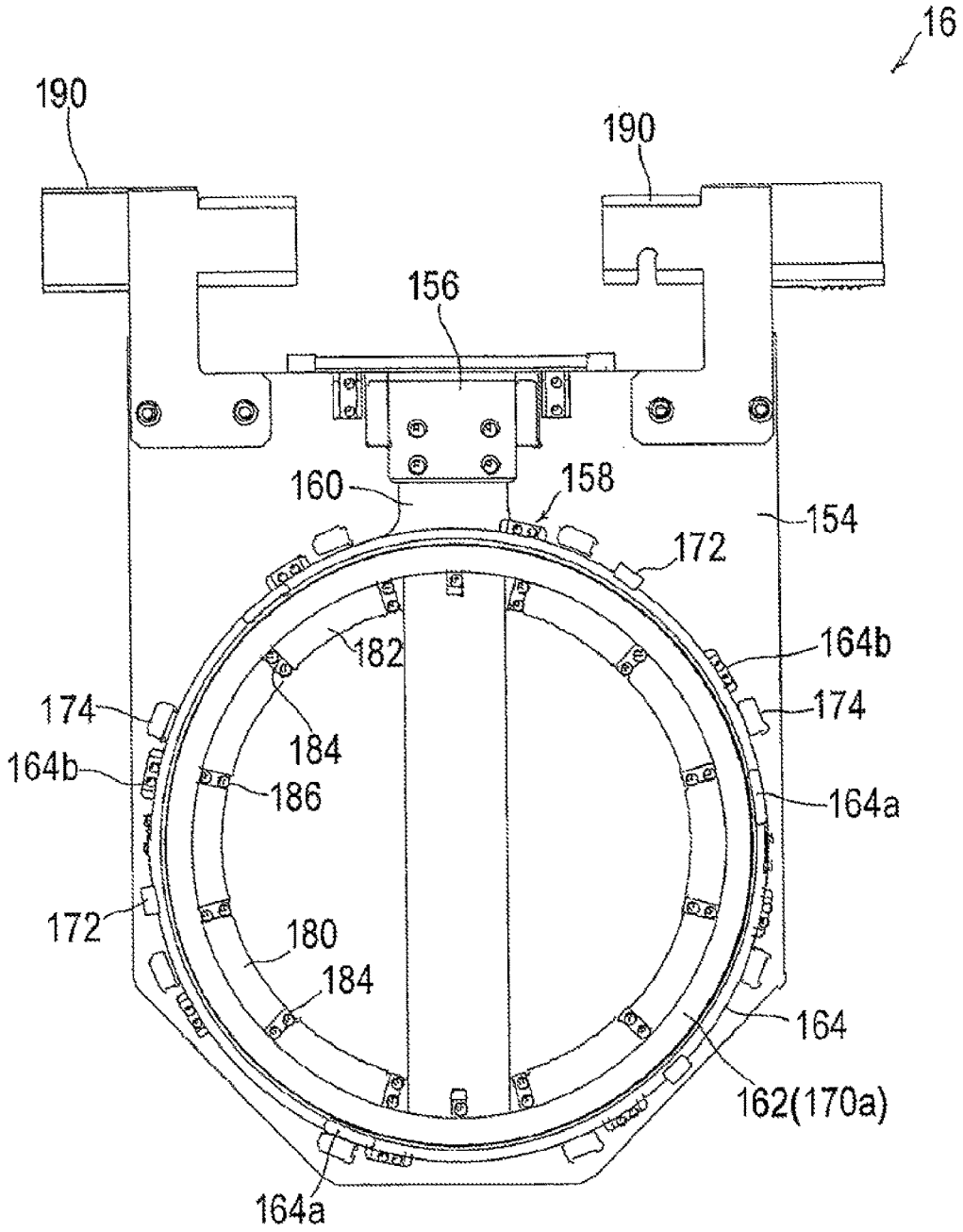
FIG. 3 is a plan view of the substrate holder shown in FIG. 1.
Figure 4:
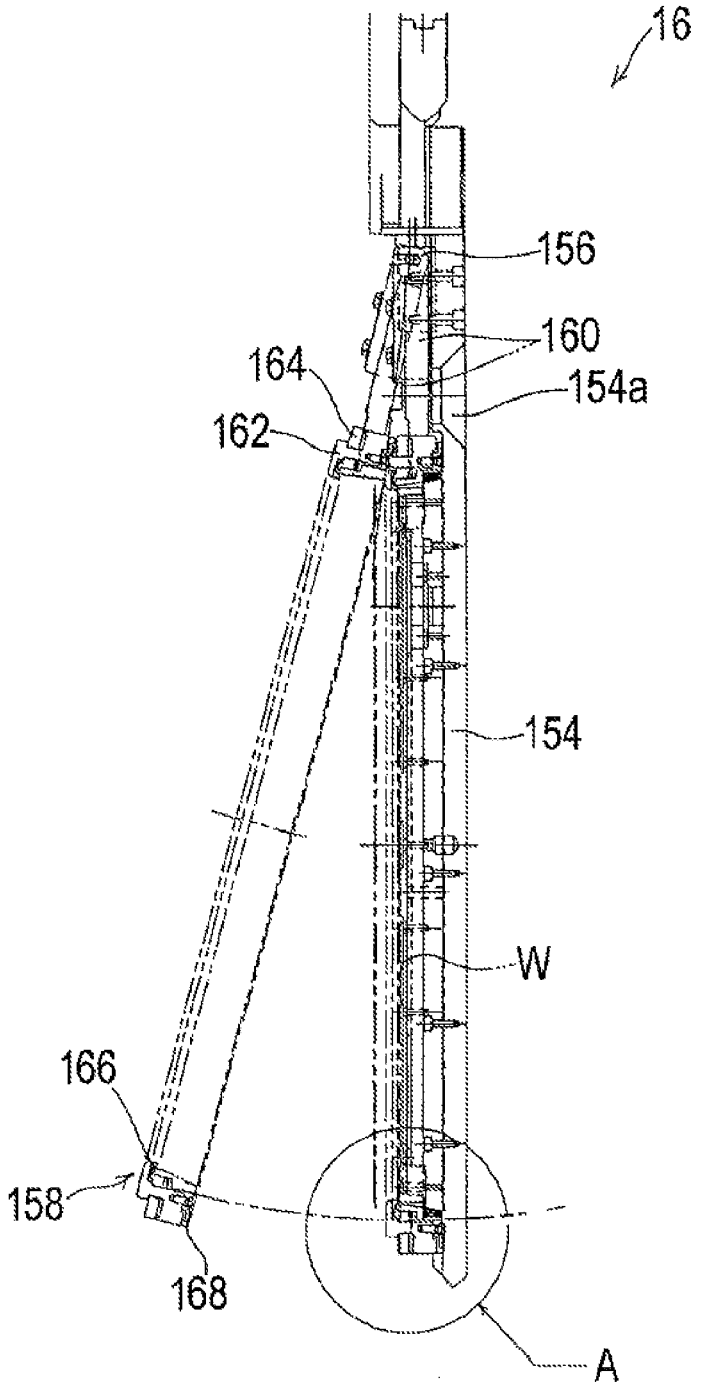
FIG. 4 is a right side view of the substrate holder shown in FIG. 1.

As shown in FIG. 3, a plurality of electrical conductors (electrical contacts) 186 (e.g., 12 conductors as illustrated), coupled respectively to wires extending from external contacts (not shown) provided in the holder hanger 190, are disposed in the recesses 184 of the protruding portion 182. When the substrate W is placed on the support surface 180 of the first holding member 154, end portions of the electrical conductors 186 resiliently contact the lower portions of the electrical contacts 188 shown in FIG. 5.

The electrical contacts 188, which are to be electrically coupled to the electrical conductors 186, are secured to the seal holder 162 of the second holding member 158 by fastening tools 189, such as bolts. The electrical contacts 188 each have a leaf spring-like contact portion located outside the substrate-side sealing member 166 and projecting inwardly. This contact portion is springy and bends easily. When the substrate W is held by the first holding member 154 and the second holding member 158, the contact portions of the electrical contacts 188 make elastic contact with the peripheral surface of the substrate W supported on the support surface 180 of the first holding member 154.

The second holding member 158 is opened and closed by a not-shown pneumatic cylinder and by the weight of the second holding member 158 itself. More specifically, the first holding member 154 has a through-hole 154*a*, and a pneumatic cylinder is provided so as to face the through-hole 154*a*. The second holding member 158 is opened by extending a piston rod of the pneumatic cylinder through the through-hole 154*a* to push up the seal holder 162 of the second holding member 158. The second holding member 158 is closed by its own weight when the piston rod is retracted.

The operation of the plating apparatus according to the embodiment will now be described. The pump 24 is set in motion to cause the plating solution Q in the plating bath 10 to circulate through the plating-solution circulation line 32, while the substrate W, held by the substrate holder 16, is immersed in the plating solution Q in the plating bath 10. The insoluble anode 12 is electrically connected to the positive electrode of the plating power source 18, and a conductive layer, such as a seed layer, that forms the surface of the substrate W is electrically connected the negative electrode of the plating power source 18, so that plating of the substrate W is started. During plating, as necessary, the agitating paddle (i.e., the agitating tool) 38 is reciprocated parallel to the substrate W to agitate the plating solution Q in the plating bath 10.

As Sn—Ag alloy plating is carried out with the use of the insoluble anode 12 in this manner, Sn ions (and Ag ions) in the plating solution Q are consumed with the progress of plating, and therefore the Sn concentration of the plating solution is gradually lowered.

Thus, the Sn concentration of the plating solution is analyzed by an Sn concentration analyzer (not shown). When an analysis value is lowered below a limit value, the plating solution Q is replenished with Sn ions together with methanesulfonic acid. Specifically, a part of the plating solution Q, flowing in the plating-solution circulation line 32, is introduced through the plating-solution introduction line 82 into the anode chamber 66 of the electrolytic bath 62. On the other hand, the cathode chamber 68 has been filled in advance with the electrolytic solution E containing methanesulfonic acid.

When a sufficient amount of the plating solution Q has been introduced into the anode chamber 66, the Sn anode 70 is electrically connected to the positive electrode of the auxiliary power source 80, and the cathode 74 is electrically connected to the negative electrode of the auxiliary power source 80, so that electrolysis is started. As described above, during the electrolysis, Sn ions that have been dissolved from the Sn anode 70, together with methanesulfonic acid (MSA), are supplied to the plating solution Q in the anode chamber 66. The plating solution Q that has been replenished with Sn ions is returned to the overflow bath 22 of the plating bath 10 via the plating-solution return line 84. In this manner, the plating solution to be used in Sn—Ag alloy plating can be kept at a constant Sn concentration.

During the electrolysis, the methanesulfonic acid concentration of the electrolytic solution E in the cathode chamber 68 is adjusted by supplying the electrolytic solution E through the electrolytic-solution supply line 90 to the cathode chamber 68 and by discharging the electrolytic solution E from the cathode chamber 68 via the electrolytic-solution discharge line 92.

In the above-described embodiment, the Sn concentration of the plating solution is analyzed by the Sn concentration analyzer, and the plating solution Q is replenished with Sn ions together with methanesulfonic acid when an analysis value becomes lower than a limit value. Alternatively, it is also possible to calculate an accumulated value of electric current flowing between the insoluble anode 12 and the substrate W during plating and to replenish the plating solution Q with Sn ions together with methanesulfonic acid when the accumulated value of the electric current has reached a predetermined value.

When the plating solution Q is replenished with Sn ions together with methanesulfonic acid, an amount of methanesulfonic acid becomes excessive and the concentration of methanesulfonic acid in the plating solution Q increases. The concentration of methanesulfonic acid in the plating solution Q also increases as a result of separation of methanesulfonic acid as a free acid from tin methanesulfonate and silver methanesulfonate. If the concentration of methanesulfonic acid in the plating solution Q becomes higher than an allowable value, the resulting metal film will have a poor appearance and non-uniformity of a thickness thereof. Therefore, when a methanesulfonic acid concentration analyzer (not shown) detects that the concentration of methanesulfonic acid in the plating solution Q exceeds an upper limit value, the plating solution Q is delivered through the plating-solution supply line 44 to the dialysis cell 42, so that methanesulfonic acid is removed from the plating solution Q. The plating solution Q, from which methanesulfonic acid has been removed, is returned to the overflow bath 22 of the plating bath 10. With this operation, the concentration of methanesulfonic acid in the plating solution Q to be used in plating can be adjusted within a preferable range, e.g., in a range of 60 to 250 g/L.

Examples of plating of an alloy of Sn and a metal which is nobler than Sn include, in addition to Sn—Ag alloy plating, Sn—Cu alloy plating, i.e., plating of an alloy of Sn and copper (Cu), and Sn—Bi alloy plating, i.e., plating of an alloy of Sn and Bi (bismuth). When ions of a metal, such as Ag, Cu or Bi, are brought into contact with Sn metal, displacement deposition of the metal ions occurs. The metal deposited (on the Sn metal surface) is likely to be separated and fall off. The metal that has been separated sinks in the plating solution. In the case of Sn—Pb alloy plating, the deposition of Pb can be prevented relatively easily because a Pb complex is formed. Thus, in general, displacement deposition of Pb is unlikely to occur even when Sn metal is brought into contact with an Sn—Pb alloy plating solution.

Thus, in an embodiment, pure water is supplied through the pure-water supply line 86 into the anode chamber 66 to replace the plating solution Q in the anode chamber 66 with the pure water when electrolysis is not performed over a long period of time in the electrolytic bath 62 of the Sn supply reservoir 60. Since the Sn anode 70 is immersed in the pure water, the Sn anode 70 does not make contact with Ag in the plating solution Q, and therefore Ag does not sink in the plating solution Q.

A low voltage (e.g., at least about 1 V), which is slightly higher than a standard electrode potential difference between Sn and Ag, may be applied between the cathode 74 and the Sn anode 70 in the electrolytic bath 62 when electrolysis is not performed in the electrolytic bath 62. Examples of "when electrolysis is not performed in the electrolytic bath 62" include a time when the plating solution Q begins to be introduced into the anode chamber 66 and a period of time when the plating solution Q in the anode chamber 66 is returned to the plating bath 10 in order to replace the plating solution Q in the anode chamber 66 with pure water. The application of such a low voltage can prevent settling or sedimentation of Ag in the plating solution Q upon contact of Ag in the plating solution Q with the Sn anode 70.

Figure 6:
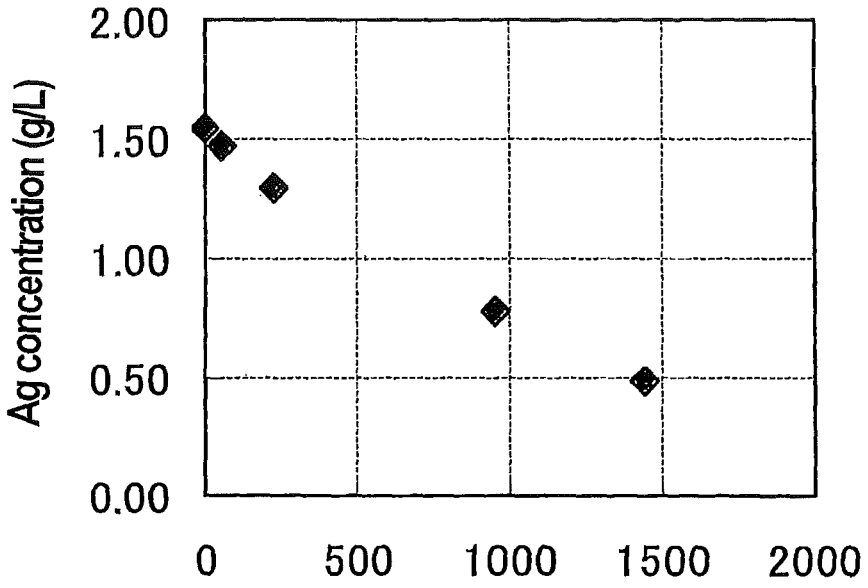
FIG. 6 is a graph showing results of an experiment in which a low voltage of at least 1 V was applied between a cathode and an Sn anode in an electrolytic bath, while a temporal change in Ag concentration of a plating solution was measured.

FIG. 6 shows results of an experiment in which a low voltage of about 1 V was applied between the cathode 74 and the Sn anode 70 in the electrolytic bath 62, while a temporal change in the Ag concentration of the plating solution was measured. In FIG. 6, vertical axis represents the Ag concentration, and horizontal axis represents time (minutes). The graph of FIG. 6 indicates that the influence of sedimentation of Ag is small.

Figure 7:
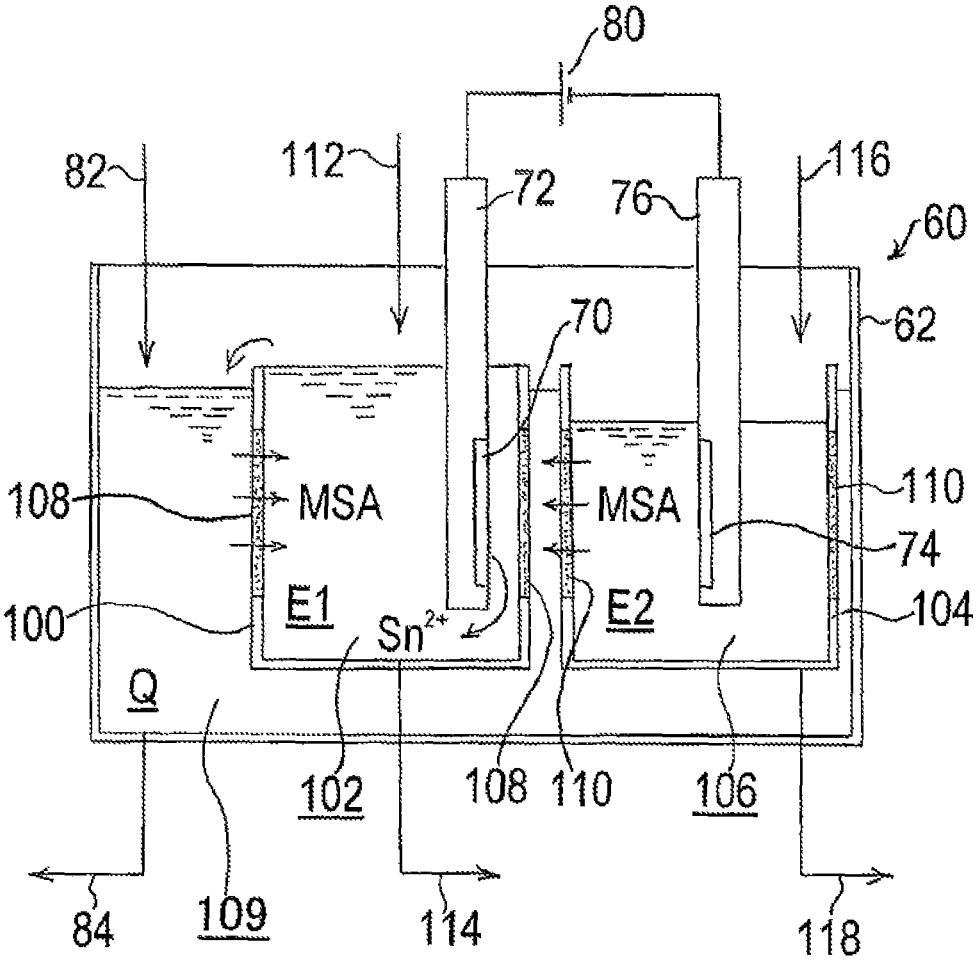
FIG. 7 is a schematic view of another exemplary Sn supply reservoir.

FIG. 7 shows another exemplary Sn supply reservoir 60. The Sn supply reservoir 60 of this embodiment includes electrolytic bath 62 having in its interior a plating-solution chamber 109. An anode chamber 102 defined by an open-top partition 100 and a cathode chamber 106 defined by an open-top partition 104 are disposed in the plating-solution chamber 109. The partitions 100, 104 each have a box-like shape with its top opened. Anion exchange membranes 108 are incorporated in the partition 100 that defines the anode chamber 102, and anion exchange membranes 110 are incorporated in the partition 104 that defines the cathode chamber 106. The plating-solution chamber 109 is adjacent to the anode chamber 102 and the cathode chamber 106, while the plating-solution chamber 109, the anode chamber 102, and the cathode chamber 106 are separated from each other by the anion exchange membranes 108, 110.

A height of the partition 100 that defines the anode chamber 102 is such that when a surface level of a first electrolytic solution E1, which is held in the anode chamber 102, rises as described below, the first electrolytic solution E1 overflows a top edge of the partition 100 into the plating-solution chamber 109 of the electrolytic bath 62.

Plating-solution introduction line 82, which is coupled to the plating-solution circulation line 32 (see FIG. 1), and plating-solution return line 84, which is coupled to the top of the overflow bath 22 (see FIG. 1) of the plating bath 10, are coupled to the electrolytic bath 62. The plating solution Q that has been drawn from the plating-solution circulation line 32 is delivered through the plating-solution introduction line 82 and is introduced into the plating-solution chamber 109. The plating solution Q in the plating-solution chamber 109 is returned to the overflow bath 22 via the plating-solution return line 84.

A first electrolytic-solution supply line 112 for supplying the first electrolytic solution E1 containing methanesulfonic acid into the anode chamber 102 is coupled to the anode chamber 102. A first electrolytic-solution discharge line 114 for discharging the first electrolytic solution E1 out of the anode chamber 102 is also coupled to the anode chamber 102. Sn anode 70, held by anode holder 72, is disposed at a predetermined location in the anode chamber 102 and is immersed in the first electrolytic solution E1.

A second electrolytic-solution supply line 116 for supplying a second electrolytic solution E2 containing methanesulfonic acid into the cathode chamber 106 is coupled to the cathode chamber 106. A second electrolytic-solution discharge line 118 for discharging the second electrolytic solution E2 out of the cathode chamber 106 is also coupled to the cathode chamber 106. Cathode 74, held by cathode holder 76, is disposed at a predetermined location in the cathode chamber 106 and is immersed in the second electrolytic solution E2.

When there arises a need to replenish the plating solution Q, flowing in the plating-solution circulation line 32 (see FIG. 1), with Sn ions, the plating solution Q is introduced into the plating-solution chamber 109 of the electrolytic bath 62 of the Sn supply reservoir 60. On the other hand, the anode chamber 102 has been filled in advance with the first electrolytic solution E1 and the cathode chamber 106 has been filled in advance with the second electrolytic solution E2.

Electrolysis is then carried out by electrically connecting the Sn anode 70 to the positive electrode of the auxiliary power source 80 and electrically connecting the cathode 74 to the negative electrode of the auxiliary power source 80. During the electrolysis, Sn ions dissolve from the Sn anode 70 into the first electrolytic solution E1 while, at the same time, methanesulfonic acid (MSA) in the plating-solution chamber 109, together with water molecules, passes through the anion exchange membranes 108 and migrates into the anode chamber 102. As a result, the surface level of the first electrolytic solution E1 in the anode chamber 102 rises. With the rise of the surface level, the first electrolytic solution E1 in the anode chamber 102 overflows the partition 100 into the plating-solution chamber 109, whereby Sn ions, together with methanesulfonic acid, are supplied to the plating solution Q in the plating-solution chamber 109. The plating solution Q in the plating-solution chamber 109 is returned to the overflow bath 22 via the plating-solution return line 84.

In this embodiment, no Ag ions are present in the anode chamber 102. Therefore, displacement deposition of Ag ions and falling of Ag metal, which would be caused by contact of Ag ions with the Sn anode 70, do not occur. Moreover, the plating solution Q does not come into contact with the Sn anode 70 in the electrolytic bath 62. Therefore, the electrolytic bath 62 may be filled with the plating solution Q even during the period of time when electrolysis is not performed in the electrolytic bath 62.

Methanesulfonic acid (MSA) contained in the second electrolytic solution E2 in the cathode chamber 106, together with water molecules, passes through the anion exchange membranes 110 and migrates into the plating-solution chamber 109. As a result, the surface level of the second electrolytic solution E2 in the cathode chamber 106 is lowered. If the surface level of the second electrolytic solution E2 is lowered to or below a predetermined level, the second electrolytic solution E2 is supplied through the second electrolytic-solution supply line 116.

Sn ions, together with methanesulfonic acid (MSA), can thus be supplied to the plating solution Q by the Sn supply reservoir 60, while the plating solution Q is allowed to circulate through the plating bath 10. The Sn alloy plating solution for use in Sn—Ag alloy plating can therefore be kept at a constant Sn concentration. Furthermore, the methanesulfonic acid concentration of the plating solution Q can be adjusted within a preferable range by removing excessive methanesulfonic acid from the plating solution Q by the dialysis cell 42. In addition, the Sn supply reservoir 60 and the dialysis cell 42 can be installed at a distance from the plating bath 10. Therefore, the Sn supply reservoir 60 and the dialysis cell 42 can be relatively easily added to an existing plating apparatus.

While the present invention has been described with reference to the embodiments, it is understood that the present invention is not limited to the embodiments described above, and is capable of various changes and modifications within the scope of the inventive concept as expressed herein.

What is claimed is:

1. An Sn alloy plating apparatus for depositing an alloy of Sn and a metal which is nobler than Sn on a surface of a substrate, comprising:

a plating bath configured to hold therein an Sn alloy plating solution in which an insoluble anode and the substrate are to be disposed opposite each other;

a plating-solution circulation line configured to circulate the Sn alloy plating solution in the plating bath;

a Sn supply reservoir configured to draw a part of the Sn alloy plating solution from the plating-solution circulation line, perform electrolysis in a presence of the Sn alloy plating solution to replenish the Sn alloy plating solution with Sn ions and an acid that stabilizes Sn ions, and return the Sn alloy plating solution that has been replenished with the Sn ions to the plating bath; and a dialysis unit configured to draw a part of the Sn alloy plating solution from the plating-solution circulation line, remove the acid from the Sn alloy plating solution, and then return the Sn alloy plating solution to the plating bath, wherein the Sn supply reservoir comprises:

an electrolytic bath including an anode chamber in which an Sn anode is disposed, a cathode chamber in which a cathode is disposed, and an anion exchange membrane that separates the anode chamber and the cathode chamber from each other;

an electrolytic-solution supply line configured to supply an electrolytic solution, containing acid that stabilizes Sn ions, to the cathode chamber;

an electrolytic-solution discharge line connected to the cathode chamber and configured to discharge the electrolytic solution from the cathode chamber to an outside of the Sn alloy plating apparatus when a concentration of the acid that stabilizes Sn ions contained in the electrolytic solution in the cathode chamber is lowered during the electrolysis;

a plating-solution introduction line configured to draw the Sn alloy plating solution from the plating-solution circulation line and introduce the drawn Sn alloy plating solution into the anode chamber; and a plating-solution return line configured to return the Sn alloy plating solution in the anode chamber to the plating bath.

2. The Sn alloy plating apparatus according to claim 1, wherein the Sn supply reservoir further comprises:

a pure-water supply line configured to supply pure water into the anode chamber; and a pure-water discharge line configured to discharge the pure water from the anode chamber.

3. An Sn alloy plating apparatus for depositing an alloy of Sn and a metal which is nobler than Sn on a surface of a substrate, comprising:

a plating bath configured to hold therein an Sn alloy plating solution in which an insoluble anode and the substrate are to be disposed opposite each other;

a plating-solution circulation line configured to circulate the Sn alloy plating solution in the plating bath;

an Sn supply reservoir configured to draw a part of the Sn alloy plating solution from the plating-solution circulation line, perform electrolysis in a presence of the Sn alloy plating solution to replenish the Sn alloy plating solution with Sn ions and an acid that stabilizes Sn ions, and return the Sn alloy plating solution that has been replenished with the Sn ions to the plating bath; and a dialysis unit configured to draw a part of the Sn alloy plating solution from the plating-solution circulation line, remove the acid from the Sn alloy plating solution, and then return the Sn alloy plating solution to the plating bath, wherein the Sn supply reservoir comprises:

an electrolytic bath including an anode chamber in which an Sn anode is disposed, a cathode chamber in which a cathode is disposed, a plating-solution chamber being adjacent to the anode chamber and the cathode chamber, a first anion exchange membrane that separates the anode chamber from the plating-solution chamber, and a second anion exchange membrane that separates the cathode chamber from the plating-solution chamber;

electrolytic-solution supply lines configured to supply an electrolytic solution, containing acid that stabilizes Sn ions, to the anode chamber and the cathode chamber;

electrolytic-solution discharge lines configured to discharge the electrolytic solution from the anode chamber and the cathode chamber;

a plating-solution introduction line configured to draw the Sn alloy plating solution from the plating-solution circulation line and introduce the drawn Sn alloy plating solution into the plating-solution chamber;

a plating-solution return line configured to return the Sn alloy plating solution in the plating-solution chamber to the plating bath; and a power source configured to apply a voltage between the Sn anode and the cathode to cause the electrolytic solution in the anode chamber to overflow into the plating-solution chamber.

* * * * *